US008347460B2

(12) United States Patent
Minegishi

(10) Patent No.: US 8,347,460 B2
(45) **Date of Patent: *Jan. 8, 2013**

(54) CHECKER-EQUIPPED DOOR HINGE DEVICE FOR VEHICLE

(75) Inventor: Yumiko Minegishi, Sakado (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 516 days.

This patent is subject to a terminal disclaimer.

(21) Appl. No.: 12/582,490

(22) Filed: Oct. 20, 2009

(65) Prior Publication Data

US 2010/0139044 A1 Jun. 10, 2010

(30) Foreign Application Priority Data

Oct. 29, 2008 (JP) ..... 2008-278241

(51) Int. Cl.
*E05D 11/10* (2006.01)

(52) U.S. Cl. ..... 16/333; 16/86 A; 16/334; 16/344; 16/DIG. 17

(58) Field of Classification Search ..... 16/86 A, 16/319, 321, 333, 334, 342–344, DIG. 17, 16/DIG. 43
See application file for complete search history.

(56) References Cited

U.S. PATENT DOCUMENTS 4,864,687 A * 9/1989 Calcaterra et al. ..... 16/237
5,018,243 A * 5/1991 Anspaugh et al. ..... 16/335
5,029,364 A * 7/1991 Salazar ..... 16/382
5,074,010 A * 12/1991 Gignac et al. ..... 16/334
5,867,869 A * 2/1999 Garrett et al. ..... 16/252
6,141,831 A * 11/2000 Novin et al. ..... 16/330
6,213,881 B1 * 4/2001 Sasa et al. ..... 464/24
6,481,056 B1 11/2002 Jesse
6,594,859 B2 * 7/2003 Barthelemy et al. ..... 16/334
6,901,634 B2 * 6/2005 Shaw et al. ..... 16/344
7,076,836 B1 * 7/2006 Butka ..... 16/342
7,487,572 B2 * 2/2009 Nelson ..... 16/334
8,108,969 B2 * 2/2012 Ochiai ..... 16/334
2001/0013155 A1 * 8/2001 Barthelemy et al. ..... 16/334
2001/0022011 A1 * 9/2001 Vittorio ..... 16/334
2005/0086770 A1 * 4/2005 Watson et al. ..... 16/334
2010/0018004 A1 * 1/2010 Ochiai et al. ..... 16/250

* cited by examiner

*Primary Examiner* — Roberta Delisle
(74) *Attorney, Agent, or Firm* — Arent Fox LLP

(57) ABSTRACT

A door hinge device for vehicle includes a checking-force generating mechanism provided between an inner cylinder and an outer cylinder. The checking-force generating mechanism has a holding member attached to the outer cylinder, an elastic member biasing the holding member toward the inner cylinder, a detent roller being held in a holding groove of the holding member, and detent grooves that are provided in an outer peripheral surface of the inner cylinder and are capable of holding the door at a plurality of positions where the door should be stopped by an engagement with the detent roller. The detent roller applies a compression load to the elastic member even in a state where the detent roller is engaged with any of the detent grooves. An assembly groove is provided in the outer peripheral surface of the inner cylinder and allows the detent roller to be inserted into the holding groove in a state where the holding member is in contact with the outer peripheral surface of the inner cylinder. Accordingly, it is possible to exert an enough checking-force at a predetermined position where the door should be stopped and to allow the detent roller to be easily inserted into the holding groove at the time of the assembling.

2 Claims, 11 Drawing Sheets

DOOR CLOSED STATE

DOOR FULLY OPENED STATE

CHECKER-EQUIPPED DOOR HINGE DEVICE FOR VEHICLE

BACKGROUND OF THE INVENTION

1. Field of the Invention

The present invention relates to a vehicle door hinge device that supports a door for opening and closing a door opening or a tail gate of an automobile or the like. The present invention particularly relates to an improvement in a checker-equipped door hinge device for vehicle, comprising: a first bracket fixed to one of a body and a door; a second bracket fixed to the other of the body and the door; a hinge pin connecting the first and second brackets to each other while allowing the brackets to be relatively rotatable; an inner cylinder connected integrally to the first bracket and disposed coaxially with the hinge pin; an outer cylinder connected integrally to the second bracket and disposed so as to surround the inner cylinder in a rotatable manner relative to the inner cylinder; and a checking-force generating mechanism provided between the inner cylinder and the outer cylinder and generating a checking force against the door at a predetermined opening position of the door. In the checker-equipped door hinge device for vehicle, the checking-force generating mechanism includes: holding members attached to one of the inner cylinder and the outer cylinder and arranged in a peripheral direction, the holding members being capable of moving toward and from the other of the inner cylinder and the outer cylinder; and elastic members respectively biasing the holding members toward the other of the inner cylinder and the outer cylinder. Detent rollers are rotatably held respectively in holding grooves formed axially respectively in the holding members, and are capable of moving in a rotational manner on a peripheral surface of the other of the inner cylinder and the outer cylinder. A plurality of detent grooves are provided in the peripheral surface of the other of the inner cylinder and the outer cylinder, and the detent rollers are capable of holding the door in a snapping manner at a plurality of predetermined positions, respectively, by biasing forces of the biasing members causing the detent rollers to engage the detent grooves, respectively.

2. Description of the Related Art

Such a checker-equipped door hinge device for vehicle has already been known as disclosed in the specification of U.S. Pat. No. 6,481,056.

In such a checker-equipped door hinge device for vehicle, in order to obtain an enough checking force at each of the positions of the door, including a fully closing position, a predetermined intermediate-opening position, and a fully opening position, a load needs to be applied to an elastic member through a holding member even in a state where a detent roller is engaged with a corresponding detent groove at each of the positions of the door.

However, in assembling such a checker-equipped door hinge device, the detent roller being inserted into the holding groove with a load applied to the elastic member is subjected to an extremely large insertion resistance; thereby the assembling is not easy without using a special assembling equipment.

SUMMARY OF THE INVENTION

The present invention has been made in consideration of such circumstances, and has an objective of providing a checker-equipped door hinge device for vehicle having excellent assemblability, which is to be achieved as follows. In order for an enough checking force to be exerted at each of predetermined positions of the door, including a fully closing position, an intermediate-opening position, and a fully opening position, a load is applied to an elastic member through a holding member even when the door is at the positions where a detent roller engages a detent groove. Moreover, the detent roller can easily be inserted into a holding groove at the time of assembly.

In order to achieve the object, according to a first feature of the present invention, there is provided a checker-equipped door hinge device for vehicle, comprising: a first bracket fixed to one of a body and a door; a second bracket fixed to the other of the body and the door; a hinge pin connecting the first and second brackets to each other while allowing the brackets to be relatively rotatable; an inner cylinder connected integrally to the first bracket and disposed coaxially with the hinge pin; an outer cylinder connected integrally to the second bracket and disposed so as to surround the inner cylinder in a rotatable manner relative to the inner cylinder; and a checking-force generating mechanism provided between the inner cylinder and the outer cylinder, and generating a checking force against the door at predetermined positions of the door, the predetermined positions including a fully closing position, an intermediate-opening position, and a fully opening position. In the checker-equipped door hinge device for vehicle, the checking-force generating mechanism includes: a holding member attached to one of the inner cylinder and the outer cylinder and arranged in a peripheral direction, the holding member being capable of moving toward and from the other of the inner cylinder and the outer cylinder; an elastic member biasing the holding member toward the other of the inner cylinder and the outer cylinder; a detent roller held rotatably in a holding groove formed axially in the holding member, said detent roller being capable of moving in a rotational manner on a peripheral surface of the other of the inner cylinder and the outer cylinder; and a fully closing detent groove, an intermediate detent groove, and a fully opening detent groove which are provided in the peripheral surface of the other of the inner cylinder and the outer cylinder and at which the detent roller is capable of holding the door in the fully closing position, the intermediate-opening position, and the fully opening position, respectively, by a biasing force of the elastic member causing the detent roller to engage a corresponding one of the fully closing detent groove, the intermediate detent groove, and the fully opening detent groove. The detent roller is configured to apply a compression load to the elastic member through the holding member even in a state where the detent roller is engaged with any of the detent grooves, and an assembly groove is provided in the peripheral surface of the other of the inner cylinder and the outer cylinder, the assembly groove allowing the detent roller to be inserted into the holding groove in a state where the holding member is in contact with the peripheral surface of the other of the inner cylinder and the outer cylinder.

With the first feature of the present invention, the detent roller applies a compression load to the elastic member through the holding member, even in a state where the detent roller is engaged with any of the fully opening detent groove, the intermediate detent groove, and the fully opening detent groove. Thereby, a load is applied to the elastic member through the holding member at the predetermined positions of the door, including the fully closing position, the intermediate-opening position, and the fully opening position. Accordingly, an enough checking force against the door can be ensured. In addition, in assembling the checker-equipped door hinge device, the outer cylinder is rotated relative to the inner cylinder so that the assembly groove may face the holding groove. Thereby, the detent roller can be smoothly inserted into the holding groove using the assembly groove, with the holding member being in contact with the peripheral surface of the other of the inner cylinder and the outer cylinder.

According to a second feature of the present invention, in addition to the first feature, the assembly groove is provided in the peripheral surface of the other of the inner cylinder and the outer cylinder at a position on an opposite side of the fully closing detent groove from the intermediate detent groove.

With the second feature of the present invention, along with the opening and closing of the door, the detent roller moves within a range between the fully closing detent groove to the fully opening detent groove. The assembly groove is placed outside the fully closing detent groove, and therefore is placed outside the movement range. Accordingly, the detent roller does not reach the assembly groove. Thereby, rattling of the detent roller can be prevented.

The above description, other objects, characteristics and advantages of the present invention will be clear from detailed descriptions which will be provided for the preferred embodiment referring to the attached drawings.

DESCRIPTION OF THE PREFERRED EMBODIMENTS

Hereinafter, embodiments of the present invention will be described with reference to preferred embodiments shown in the accompanying drawings.

Figure 1:
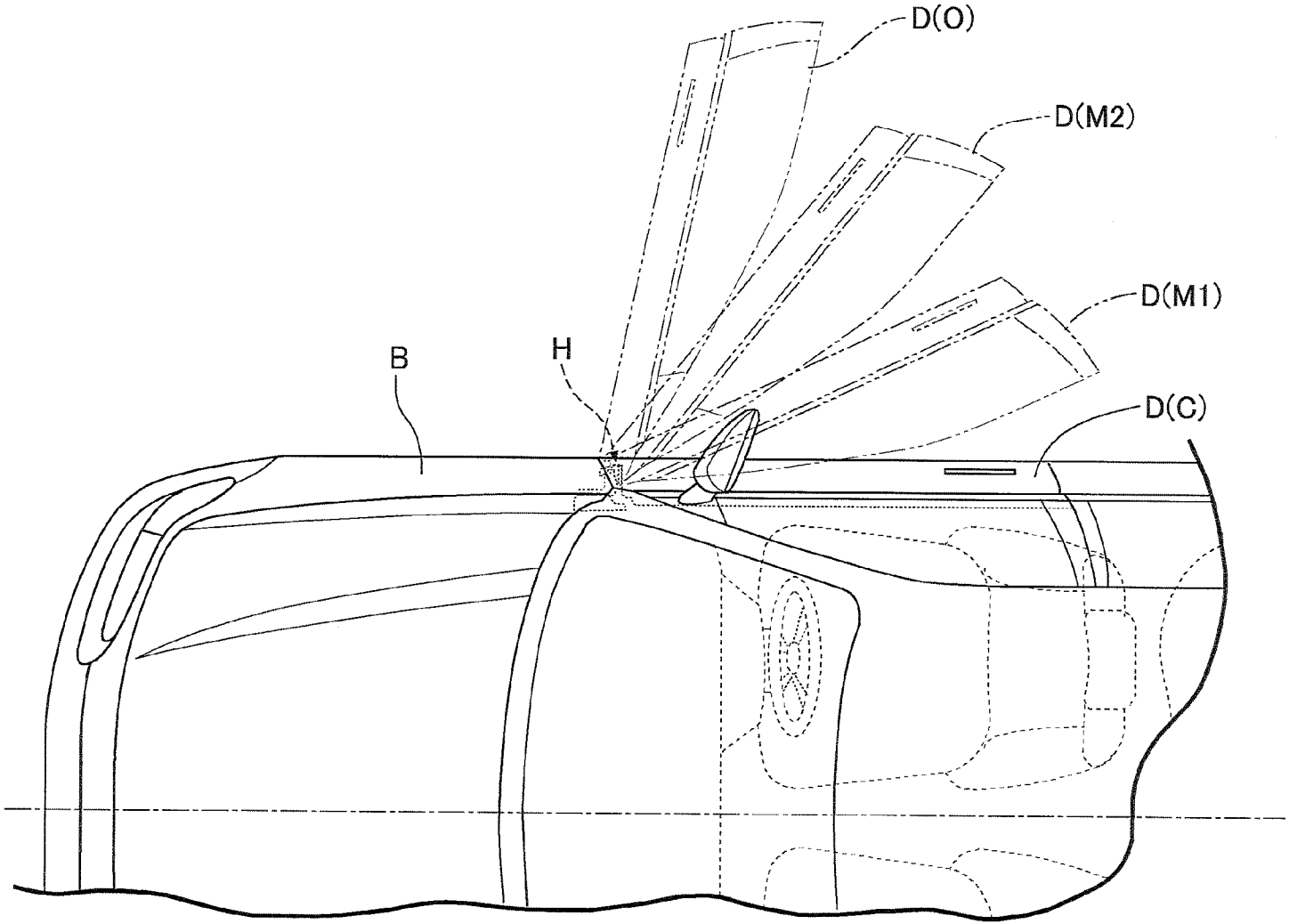
FIG. 1 is a plan view showing an essential part of an automobile including a checker-equipped door hinge device according to a first embodiment of the present invention.

Firstly, a first embodiment of the present invention shown in FIGS. 1 to 9 will be described. In FIG. 1, a door D is rotatably attached to a body B of an automobile with a checker-equipped door hinge device H interposed therebetween so that the door D can open and close the door opening of the automobile.

As shown in FIGS. 2 to 5, the checker-equipped door hinge device H includes: a female bracket 1 fixed to the body B with a plurality of bolts 3; a male bracket 2 fixed to the door D with a plurality of bolts 4; and a hinge pin 5 disposed in a vertical direction to couple these brackets 1 and 2 in a relatively rotatable manner.

The female bracket 1 has paired upper and lower female arm portions 1*a*, and paired upper and lower male arm portions 2*a* of the male bracket 2 are placed inside the respective upper and lower female arm portions 1*a* adjacently. Then, the hinge pin 5 is placed so as to penetrate these arm portions vertically. The hinge pin 5 has an enlarged head portion 5*a* at its one end and a riveting portion 5*b* at the other end, and is fixed to the female arm portions 1*a* by these portions. An inner cylinder 6 that penetrates the male arm portions 2*a*, 2*a* is fitted on an outer periphery of the hinge pin 5. Specifically, at the center, the inner cylinder 6 has a hollow portion 17 through which the hinge pin 5 penetrates. A positioning projection 8 is formed on each of opposite end portions of the inner cylinder 6, and a positioning groove 9 is formed in each of the female arm portions 1*a*, 1*a*, specifically, in its surface facing the inner cylinder 6. The positioning projection 8 engages the positioning groove 9. The positioning projection 8 has a width larger than a diameter of the hinge pin 5, and extends on the end surface of the inner cylinder 6 along its diameter line. The positioning groove 9 is formed in an inner surface of each of the female arm portions 1*a* in such a manner as to cross a through hole 18 for the hinge pin 5. One end of the positioning groove 9 is open to an outer peripheral surface of the female arm portion 1*a*. Accordingly, the positioning protrusion 8 of the inner cylinder 6 can engage the positioning groove 9 from that open end. After the engagement, the hinge pin 5 is inserted through the female arm portions 1*a*, 1*a* and the inner cylinder 6, thereby preventing removal of the positioning protrusion 8 from the positioning groove 9. The positioning protrusion 8 and the positioning groove 9 each have a trapezoidal shape in cross section so that there may be no rattling between them when they engage each other.

Figure 2:
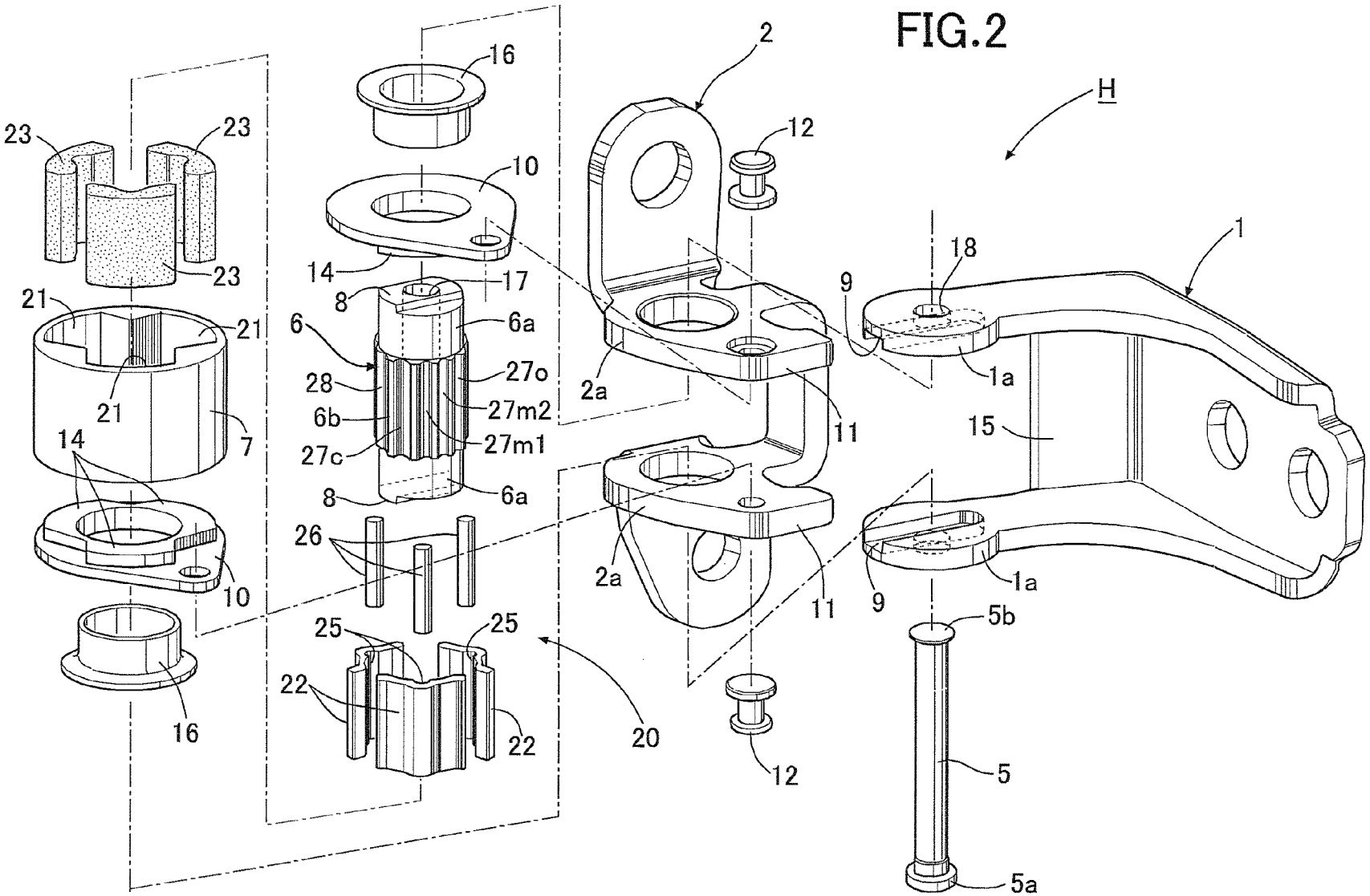
FIG. 2 is an exploded perspective view showing the checker-equipped door hinge device.
Figure 3:
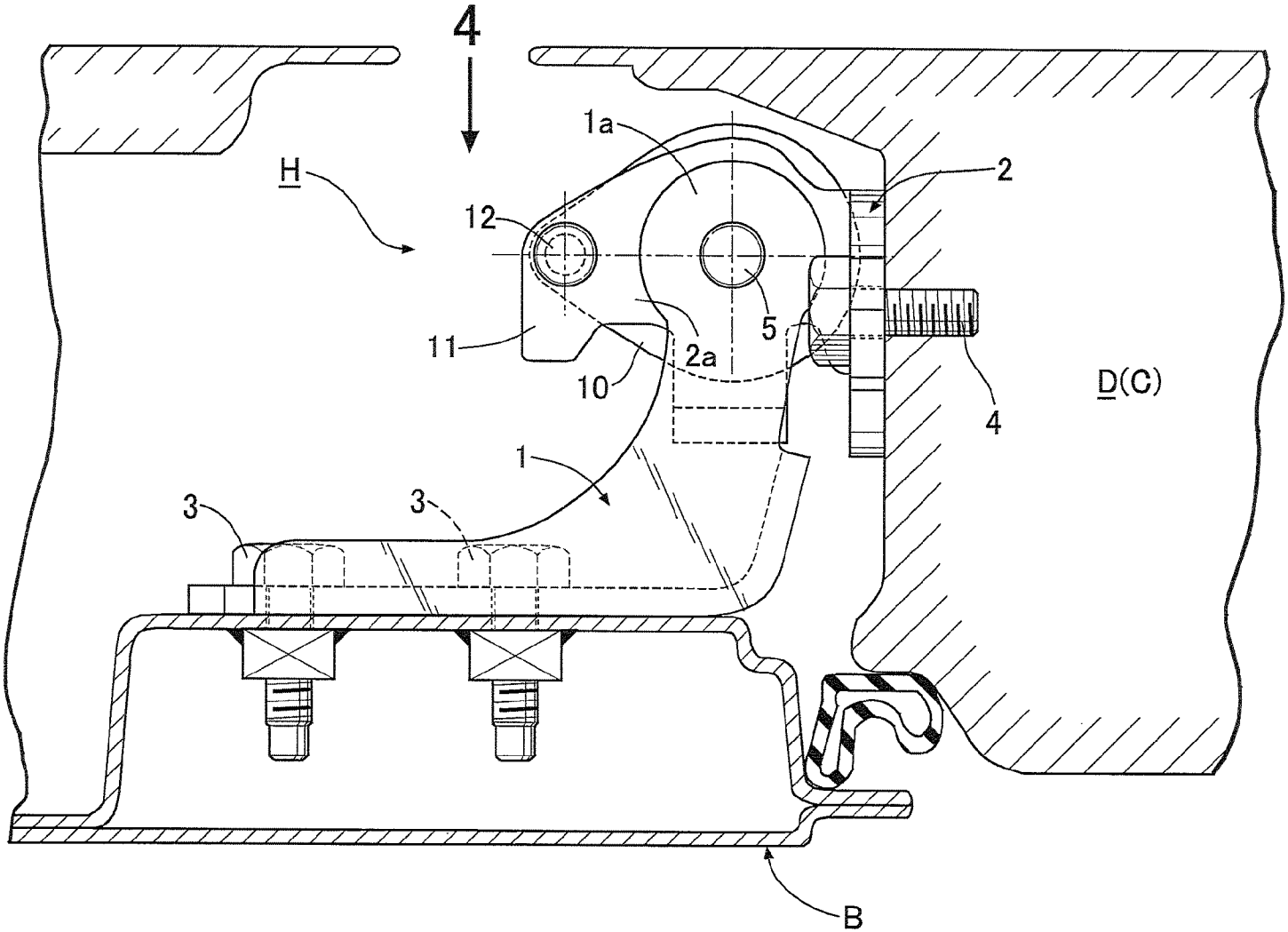
FIG. 3 is a plan view showing the checker-equipped door hinge device in a state where a door is closed.
Figure 4:
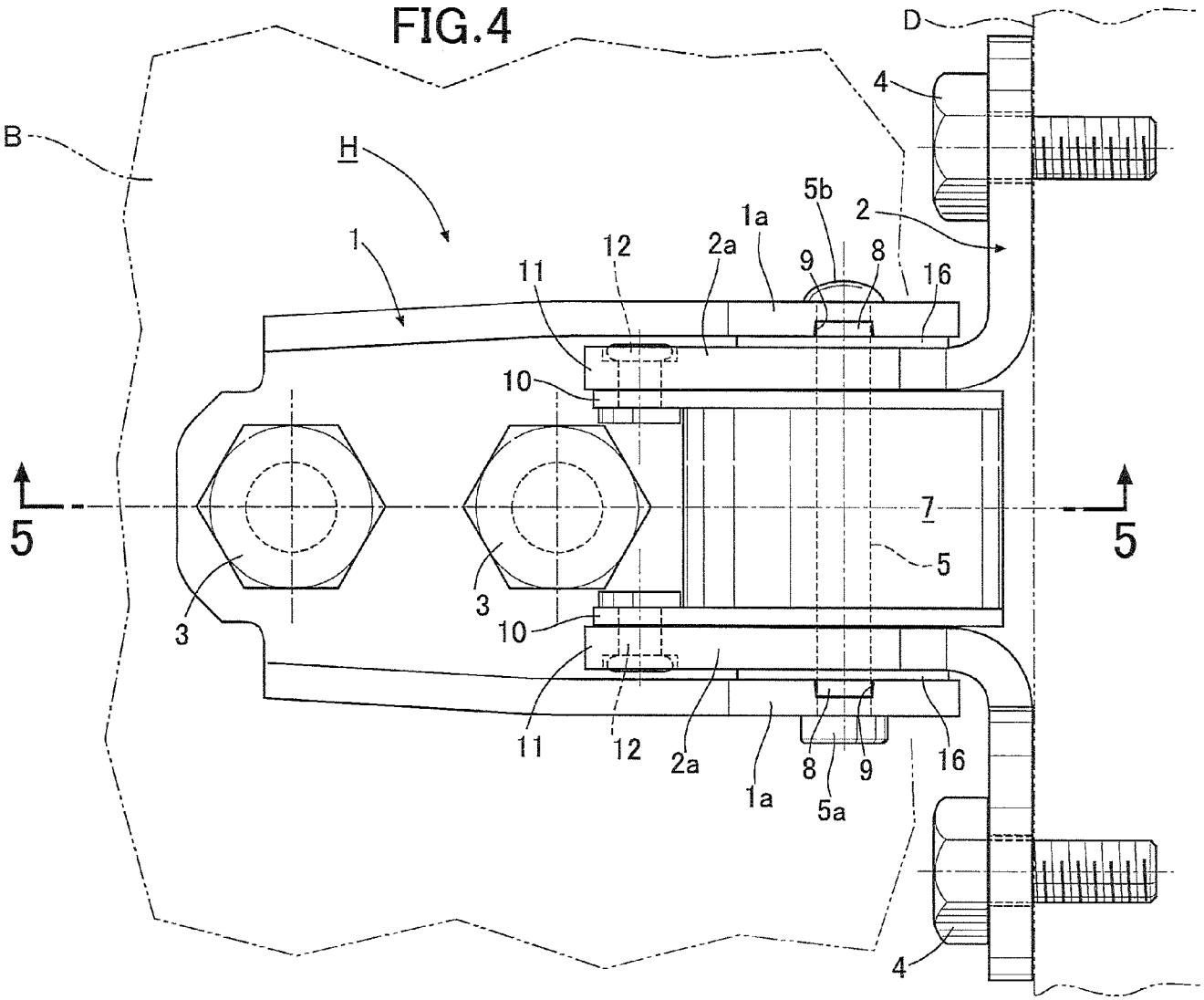
FIG. 4 is a view seen from the direction of an arrow 4 in FIG. 3.
Figure 5:
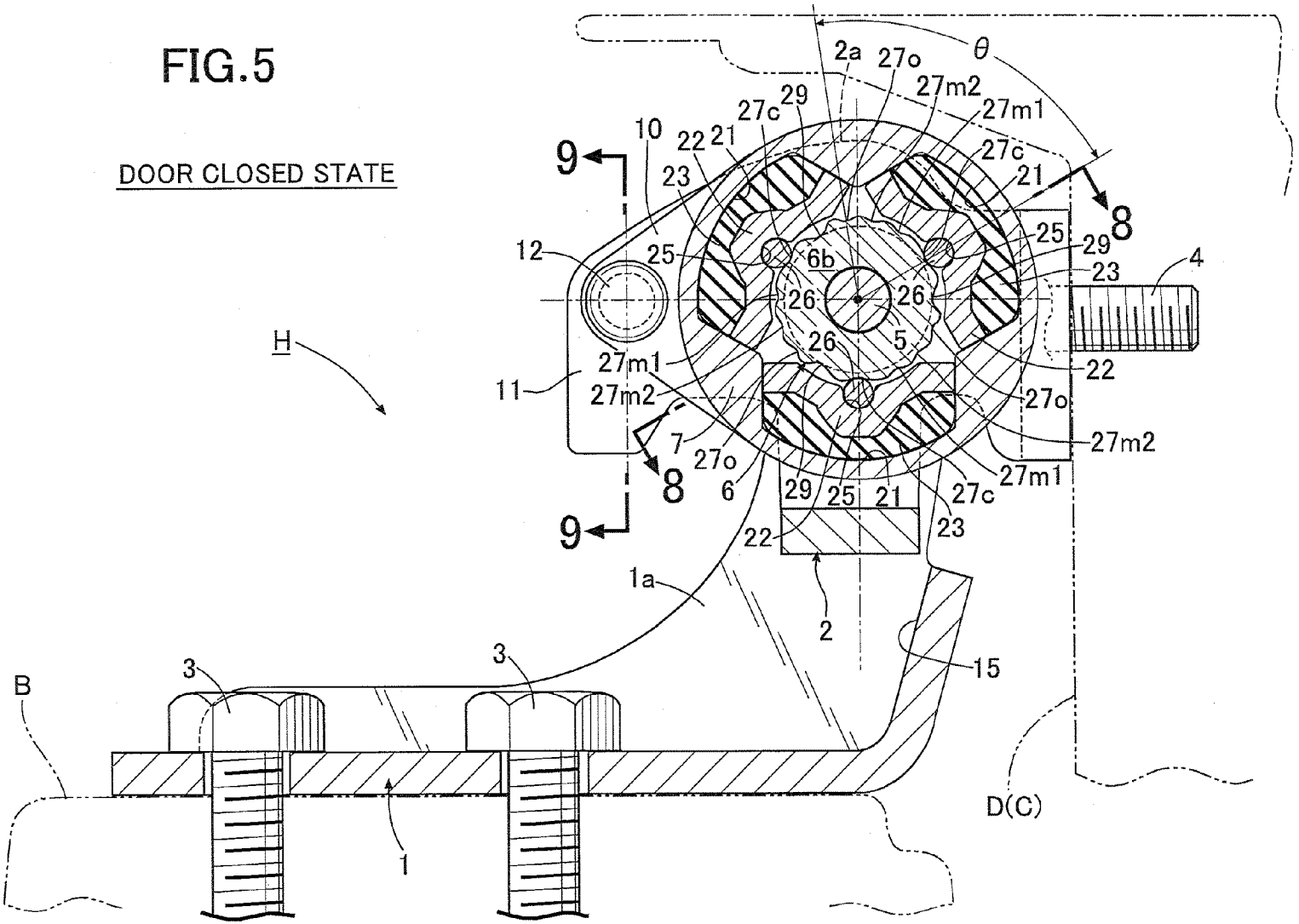
FIG. 5 is a cross-sectional view taken along a line 5-5 in FIG. 4.
Figure 8:
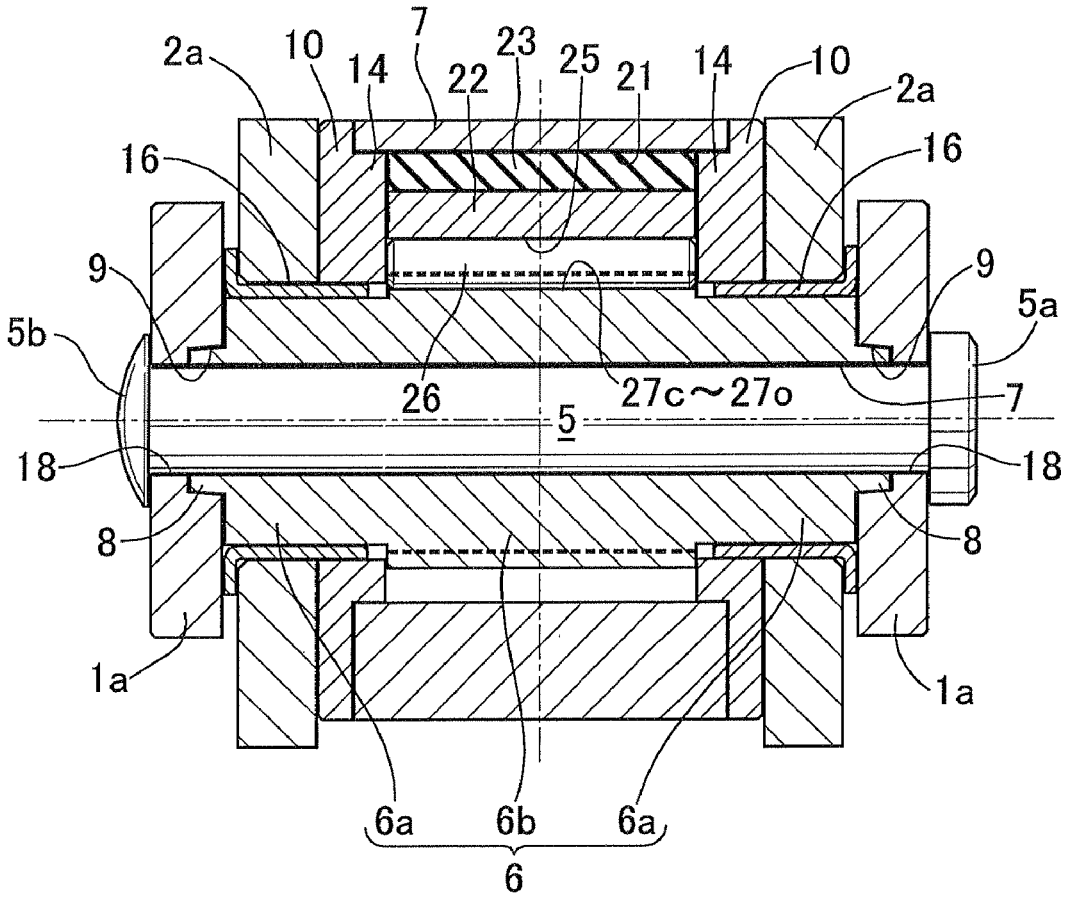
FIG. 8 is a cross-sectional view taken along a line 8-8 in FIG. 5.

As shown in FIGS. 2, 5, and 8, the paired male arm portions 2*a*, 2*a* are supported rotatably at the opposite end portions of the inner cylinder 6 through bearing bushes 16, 16, respectively. Further, an outer cylinder 7 is placed on an outer periphery of the inner cylinder 6 in such a manner as to be rotatable relative to the inner cylinder 6. Paired covers 10, 10 are placed on opposite ends of the outer cylinder 7, respectively. While sealing the inside of the outer cylinder 7, each of the covers 10, 10 is rotatably supported on an outer peripheral surface of a corresponding one of the bearing bushes 16, 16. The inner cylinder 6 has paired axial portions 6*a*, 6*a*, which are rotatably supported in the respective bearing bushes 16, 16, and a middle portion 6*b* between the axial portions 6*a*, 6*a*. The middle portion 6*b* has a diameter larger than the axial portions 6*a*, 6*a* have.

Figure 9:
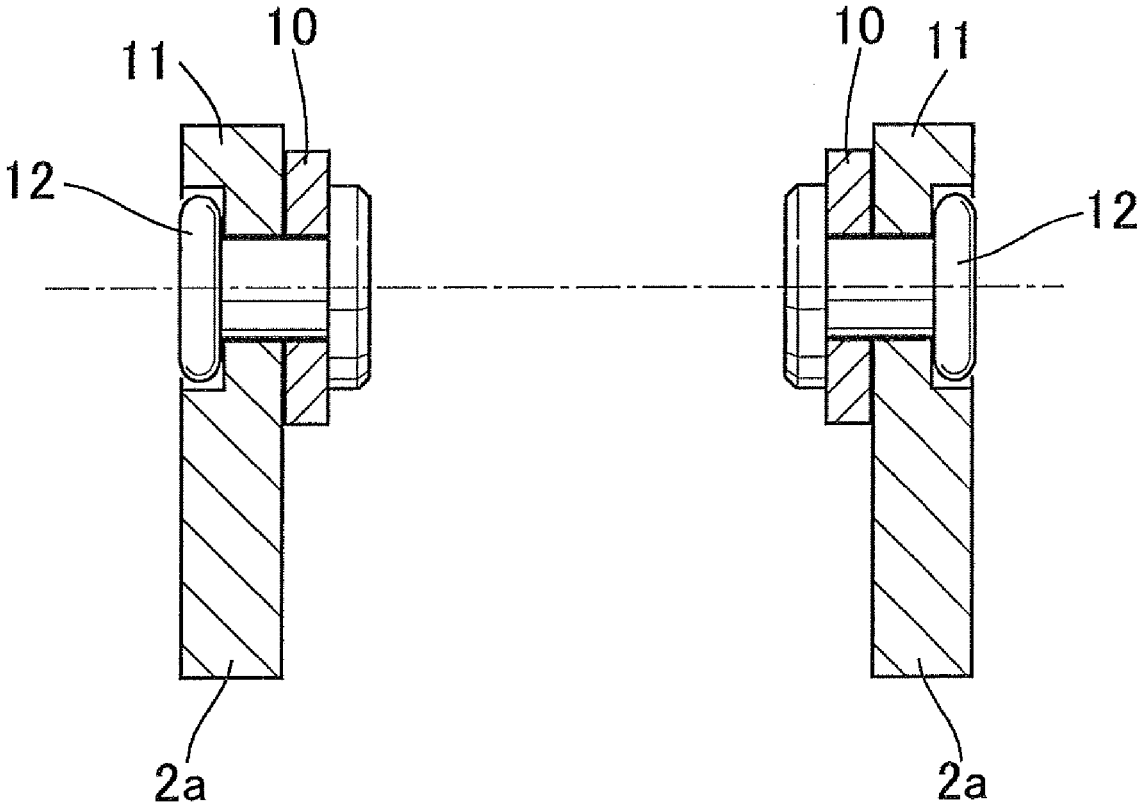
FIG. 9 is a cross-sectional view taken along a line 9-9 in FIG. 5.

As shown in FIGS. 2 and 9, each of the male arm portions 2*a*, 2*a* integrally has an ear portion 11 protruding in the radial direction. The covers 10, 10 are fixed to these ear portions 11 with rivets 12, respectively.

Referring to FIGS. 2 and 8 again, each of these covers 10, 10 has, on its inner side surface, a connecting protrusion 14. The connecting protrusions 14 are engaged respectively with an attachment concave portion 21, which will be described below, of the outer cylinder 7, so that each of the covers 10, 10 and the outer cylinder 7 are connected to one another so as to be integrally rotatable.

Figure 7:
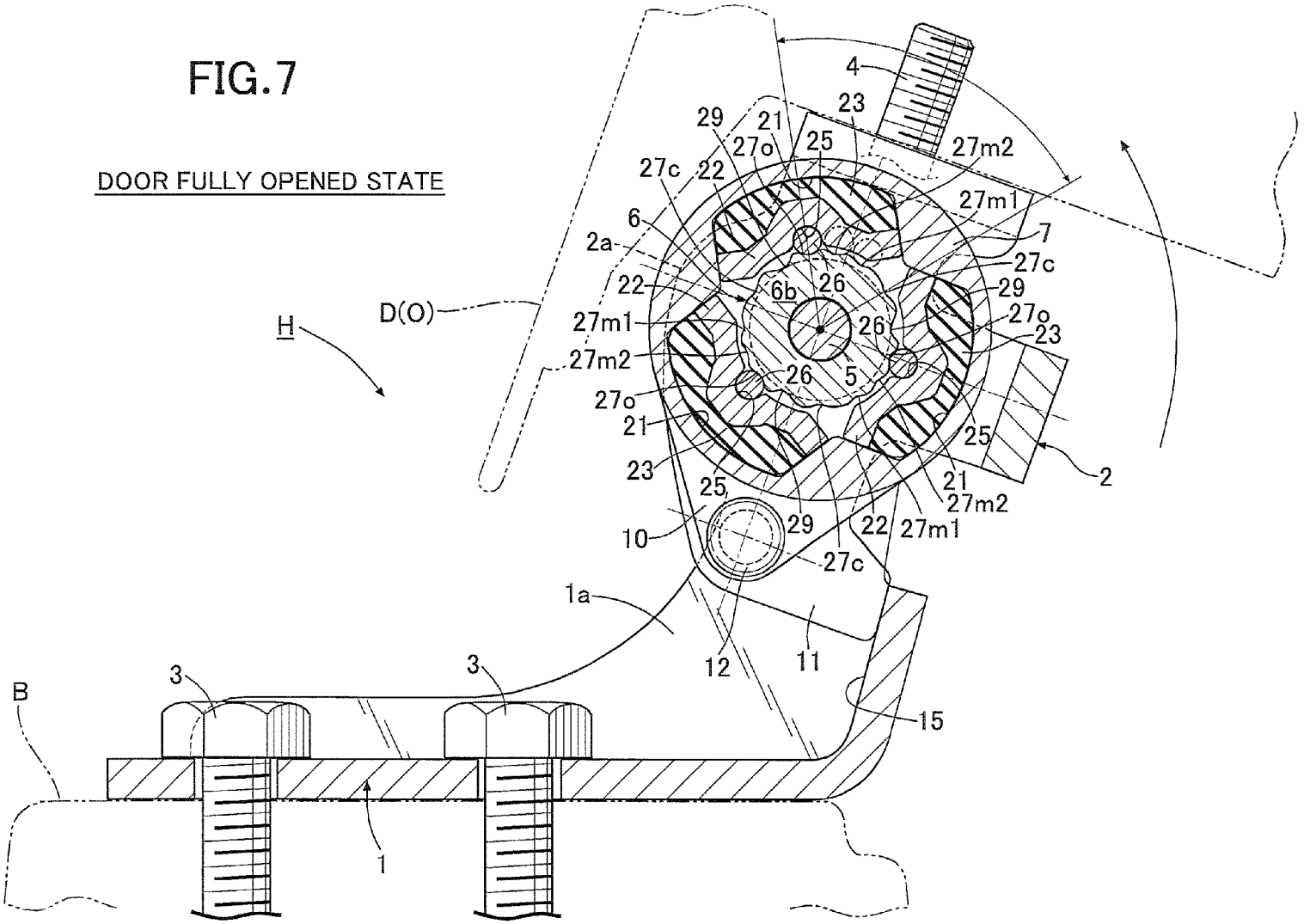
FIG. 7 is a view corresponding to FIG. 5 and showing the checker-equipped door hinge device in a state where the door is fully opened.

As shown in FIGS. 2 and 7, a stopper wall 15 is formed integrally in the female bracket 1. The stopper wall 15 restricts a fully opening position O for the door D in a way that the ear portions 11 of the male arm portions 2*a*, 2*a* come into contact with the stopper wall 15.

In FIGS. 1, 2, 5 to 8, a checking-force generating mechanism 20 is provided between the inner cylinder 6 and the outer cylinder 7. The checking-force generating mechanism 20 generates a checking force against the door D at a fully closing position C, a first intermediate-opening position M1, a second intermediate-opening position M2 and a fully opening position O of the door D. Hereinafter, the checking-force generating mechanism 20 will be described.

Formed on an inner peripheral surface of the outer cylinder 7 are a single attachment concave portion 21, or a plurality of attachment concave portions 21 arranged in a peripheral direction. In the example shown, three attachment concave portions are formed. Each attachment concave portion 21 has inner side faces that face each other in a peripheral direction of the outer cylinder 7 and that are parallel with each other. An elastic member 23 made of rubber and a holding member 22 having high rigidity are fitted into each of the attachment concave portions 21. The holding member 22 is placed to cover an inner surface in a radial direction of the elastic member 23. The holding member 22 is slidable in the radial direction inside the attachment concave portion 21. The holding member 22 has an inner peripheral surface of an arc shape that comes in close contact with an outer peripheral surface of the inner cylinder 6 when moved inward in the radial direction. A preload is applied to the elastic member 23 in a compression direction thereof so that the holding member 22 is pressed against the outer peripheral surface of the inner cylinder 6.

A holding groove 25 of a semi-columnar shape is formed in an inner peripheral surface of each holding member 22. The holding groove 25 is open to the inner cylinder 6 and extends in an axial direction of the outer cylinder 7. A substantial semi-peripheral portion of a detent roller 26 engages, and is held in, the holding groove 25 rotatably. The detent roller 26 is movable in a rotational manner on an outer peripheral surface of the middle portion 6*b* of the inner cylinder 6.

A fully closing detent groove 27*c*, a first intermediate detent groove 27*m*1, a second intermediate detent groove 27*m*2, and a fully opening detent groove 27*o* are provided in the outer peripheral surface of the middle portion 6*b* of the inner cylinder 6. A biasing force of the elastic member 23 causes each detent roller 26 to engage the detent grooves 27*c* to 27*o* in a snapping manner when the door D comes to the fully closing position C, the first intermediate-opening position M1, the second intermediate-opening position M2, and the fully opening position O, respectively. Each of these detent grooves 27*c* to 27*o* has either a minor-arc shape or a V shape in cross section. Accordingly, not only when rolling on the outer peripheral surface of the middle portion 6*b* of the inner cylinder 6, but also when engaging the detent grooves 27*c* to 27*o*, the detent roller 26 applies a compression preload to the elastic member 23 by pressing the holding member 22 away from the outer peripheral surface of the middle portion 6*b*. Consequently, when the detent roller 26 engages the fully closing detent groove 27*c*, the first intermediate detent groove 27 *m*1, the second intermediate detent groove 27 *m*2, and the fully opening detent groove 27*o*, a repulsive force of the elastic member 23 allows generation of a checking force against the door D.

Figure 6:
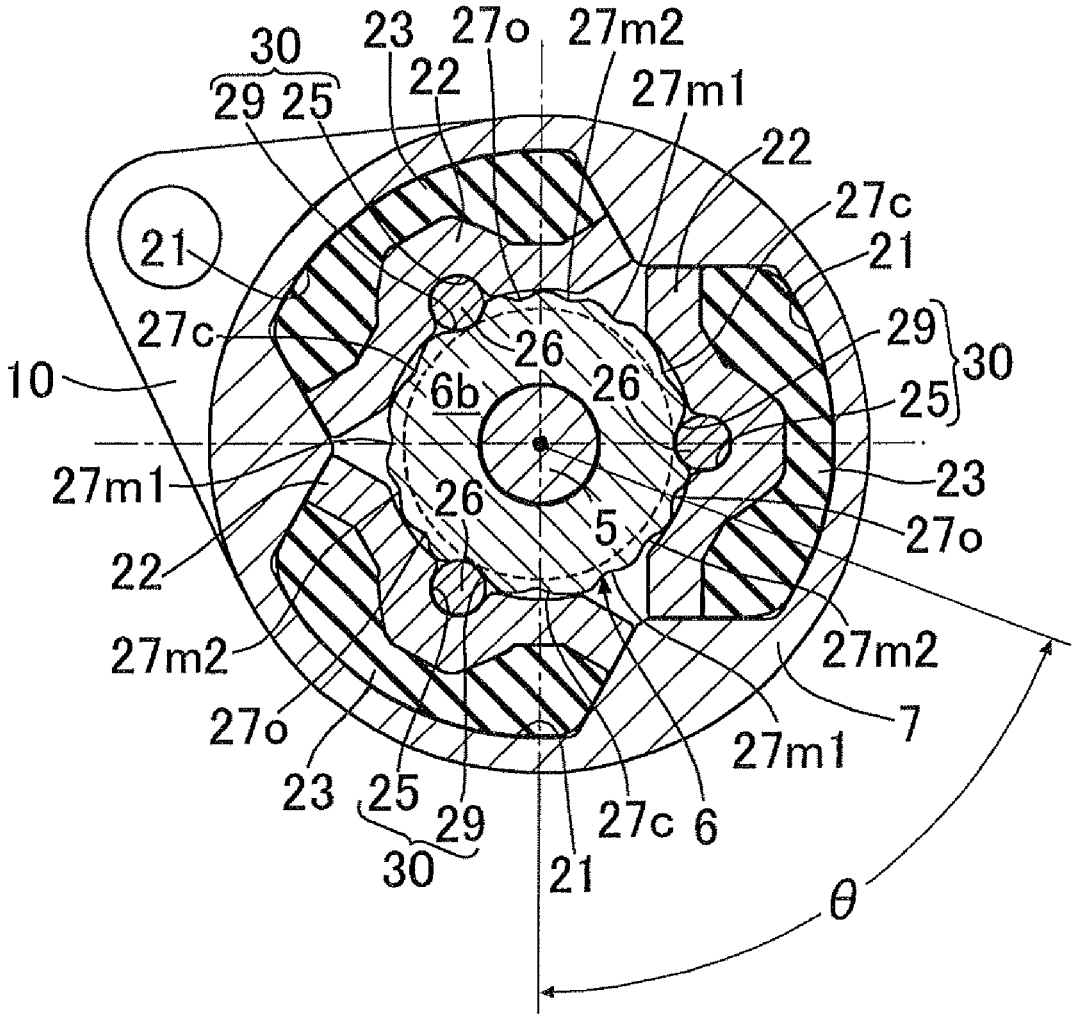
FIG. 6 is a view explaining a procedure of an attachment of a detent roller of the checker-equipped door hinge device.

Particularly, as clearly shown in FIG. 6, assembly grooves 29 are further provided in the outer peripheral surface of the middle portion 6*b* of the inner cylinder 6. Before the checker-equipped door hinge device H is installed in the vehicle, each assembly groove 29 allows the detent roller 26 to be inserted into the holding groove 25 in a state where the holding member 22 is in contact with the outer peripheral surface of the middle portion 6*b*. Specifically, each assembly groove 29 is provided in the outer peripheral surface of the middle portion 6*b* of the inner cylinder 6 at a position on an opposite side of the fully closing detent groove 27*c* from the first intermediate detent groove 27 *m*1. The assembly groove 29 is formed deeper than each of the detent grooves 27*c* to 27*o* so that, even in a state where the holding member 22 is in contact with the outer peripheral surface of the middle portion 6*b*, the assembly groove 29, when facing the holding groove 25, may form an insertion hole 30 having a diameter larger than the detent roller 26 has, together with the holding groove 25.

As shown in FIGS. 2 and 8, the movements of the holding members 22, the elastic members 23, and the detent rollers 26 in the axial direction are restricted by the covers 10 closing the respective opposite ends of the outer cylinder 7.

The checking-force generating mechanism 20 is provided to a thick wall portion 7*a* of the outer cylinder 7 in the above-described manner.

Next, operations of this embodiment are described.

The checker-equipped door hinge device H is assembled before installed in the vehicle. The elastic member 23 and the holding member 22 are fitted to each of the attachment concave portions 21 of the outer cylinder 7. Then, when the inner cylinder 6 is to be inserted into the holding members 22, the middle portion 6*b* of the inner cylinder 6 presses all the holding members 22 outward in the radial direction to compress all the elastic members 23. In other words, a preload is applied to the elastic members 23.

Next, the detent roller 26 is inserted into the holding groove 25 of each of the holding members 22. Here, as shown in FIG. 6, first, the outer cylinder 7 is rotated relative to the inner cylinder 6 so that the holding groove 25 of each of the holding members 22 supported by the outer cylinder 7 may face a corresponding one of the assembly grooves 29 of the outer peripheral surface of the middle portion 6*b* of the inner cylinder 6. When facing each other, the holding groove 25 and the assembly groove 29 together form the insertion hole 30 having a diameter larger than the detent roller 26 has, as already described. Accordingly, by being inserted into this insertion hole 30 in the axial direction, the detent roller 26 can be inserted smoothly into the holding groove 25 in the axial direction, without moving the holding member 22 outward in the radial direction, but with the holding member 22 being in close contact with the outer peripheral surface of the middle portion 6*b* of the inner cylinder 6.

Thereafter, the covers 10, 10 are fitted to the outer cylinder 7, and the outer cylinder 7 with the covers 10, 10 is inserted into the male bracket 2. Then, the bearing bushes 16, 16 are fitted to the respective covers 10, 10. Subsequently, the male bracket 2 is inserted into the female bracket 1, and the positioning protrusions 8, 8 on the respective end portions of the inner cylinder 6 engage with the respective positioning grooves 9, 9 of the female bracket 1. Then, the hinge pin 5 is fitted through the female bracket 1 and the inner cylinder 6.

After the checker-equipped door hinge device H is assembled, the outer cylinder 7 is rotated relative to the inner cylinder 6 again to move the detent roller 26 toward the fully closing detent groove 27*c*. In this event, the detent roller 26 gets out of the assembly groove 29 while pressing the holding member 22 outward in the radial direction and thereby compressing the elastic member 23. Then, when coming to the position of the fully closing detent groove 27*c*, the detent roller 26 is caused to engage the fully closing detent groove 27*c* by a repulsive force of the elastic member 23 being compressed. In order for the compression repulsive force of the elastic member 23 to act on the detent roller 26 even in this engagement state, the depth of each of the detent grooves 27*c* to 27*o* is set so that the holding member 22 may not come in contact with the outer peripheral surface of the middle portion 6*b* of the inner cylinder 6. This state is also true to the state where the detent roller 26 engages any of the first, second intermediate detent grooves 27 *m*1, 27 *m*2, and the fully opening detent groove 27*o*. This means that, when installed in vehicle, the checker-equipped door hinge device H can apply an enough checking force to the door D at the positions of the door D: the fully closing position C, the first, second intermediate-opening positions M1, M2, and the fully opening position O.

To install the checker-equipped door hinge H in the vehicle, the female and male brackets 1, 2 are spread away from each other with the detent rollers 26 engaging the corresponding fully opening detent grooves 27*o*, and then are fixed to the body B and the door D with the bolts 3, 4, respectively, as shown in FIG. 7.

When the user rotates the door D between the fully closing position and the fully opening position, the male bracket 2 joined to the door D rotates within a range θ between the closing position (the state shown in FIGS. 3 and 5) and the fully opening position (the state shown in FIG. 6). Accordingly, the outer cylinder 7 connected to the male bracket 2 rotates relative to the inner cylinder 6 connected to the female bracket 1. This also rotates the holding members 22 and the elastic members 23 supported in the attachment concave portions 21 of the outer cylinder 7. Therefore, the detent roller 26 held in the holding groove 25 in each of the holding members 22 moves in a rotational manner on the outer peripheral surface of the inner cylinder 6.

During the rotational movement, when the door D comes to the fully closing position C, the first, second intermediate-opening positions M1, M2, or the fully opening position O, each detent roller 26 reaches a groove corresponding to that position: the fully closing detent groove 27*c*, the first, second intermediate detent grooves 27 *m*1, 27 *m*2, or the fully opening detent groove 27*o*. Then, the holding member 22 holding the detent roller 26 is caused to move toward the inner cylinder 6 by a compression repulsive force of the elastic member 23 to firmly press the detent roller 26 into the corresponding one of the detent grooves 27*c* to 27*o*. Thus, as described earlier, an enough checking force can be applied to the door D. Especially, since a compression load is applied to the elastic members 23 even in a state where the detent rollers 26 is engaged with any of the detent grooves 27*c* to 27*o*, the holding members 22 can enhance a checking force against the door D efficiently, preventing the door D from moving freely.

When a plurality of holding members 22 and a plurality of elastic members 23 are provided in the peripheral direction of the outer cylinder 7, the checking force against the door D can be increased by a plurality of times. Moreover, since the plurality of holding members 22 and elastic members 23 operate separately, when one of the elastic members 23 loses its elastic force for some reason, the other normal elastic members 23 keep pressing the corresponding holding members 22. Thus, the checking-force generating mechanism 20 is prevented from losing its checking function, and high reliability can therefore be obtained.

By applying a rotation force equal to or larger than the checking force to the door D, the detent roller 26 compresses and deforms the elastic member 23 through the holding member 22, and gets out of the detent grooves 27*c* to 27*o*. Thus, the door D can be moved in a rotational manner.

In the manner as described, in the checker-equipped door hinge device H, along with the opening and closing of the door D, each detent roller 26 moves within the range θ between the fully closing detent groove 27*c* to the fully opening detent groove 27*o*, and therefore does not reach the assembly groove 29 formed outside the movement range θ. Thereby, rattling of the detent roller 26 can be prevented.

The paired covers 10 are attached on the respective ends of the outer cylinder 7 to seal the inside of the outer cylinder 7 and to restrict the movement of the detent roller 26, the holding members 22 and the elastic members 23 in the axial direction. This prevents rain water and dust from entering the checking-force generating mechanism 20 in the outer cylinder 7, ensuring normal functioning of the checking-force generating mechanism 20 over a long time period. Furthermore, the covers 10 serve also as stopper members that restrict movement of the detent rollers 26, the holding members 22, and the elastic members 23 in the axial direction, which can contribute to reduction in the number of components, and by extension, simplification of the structure.

Figure 10:
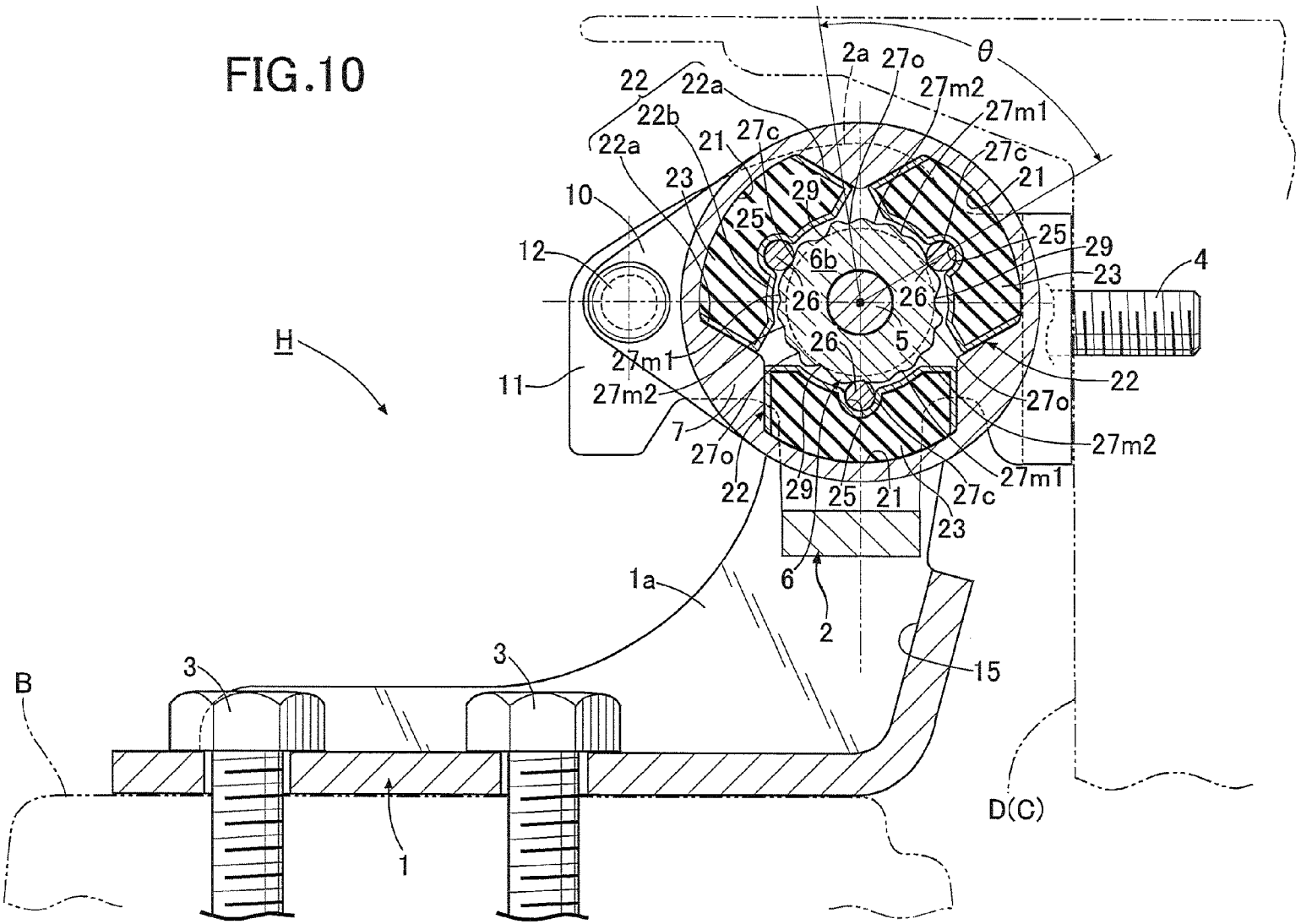
FIG. 10 is a view corresponding to FIG. 5 and showing a second embodiment of the present invention.

Next, a second embodiment of the present invention shown in FIG. 10 is described. In the second embodiment, the holding member 22 provided in each of the attachment concave portions 21 in the outer cylinder 7 is formed of a plate spring. Specifically, each holding member 22 includes paired end wall portions 22*a* and a flexible connecting wall portion 22*b*. The end wall portions 22*a* are placed to cover the respective inner walls of the attachment concave portion 21, specifically, the respective inner walls facing each other in the peripheral direction of the outer cylinder 7. The connecting wall portion 22*b* integrally connects the end wall portions 22*a* to each other. The holding groove 25 for holding the detent roller 26 is formed in the connecting wall portion 22*b*. The elastic member 23 made of rubber is filled in the attachment concave portion 21 and biases the connecting wall portion 22*b* toward the inner cylinder 6. Since the other configurations in the second embodiment are the same as those of the aforementioned embodiment, parts corresponding to those in the aforementioned embodiment are denoted by the same reference numerals in FIG. 10, and repetitive descriptions are avoided.

In the second embodiment, the flexure of the connecting wall portion 22*b* allows the resilient force of the elastic members 23 to be transmitted to the detent rollers 26. This configuration makes it possible to eliminate the sliding portion between each holding member 22 and the corresponding attachment concave portion 21, thus preventing friction noise from being generated.

Figure 11:
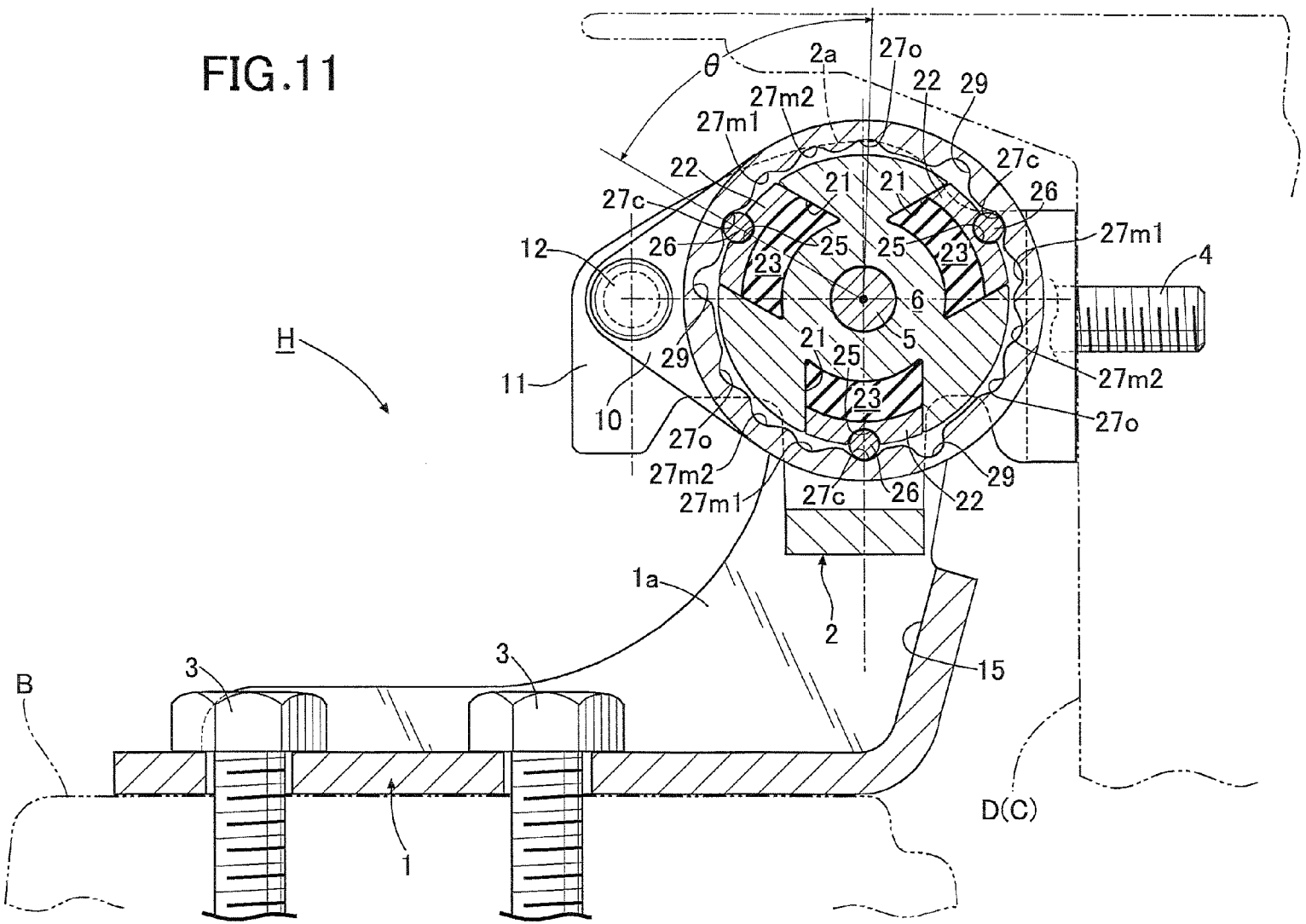
FIG. 11 is a view corresponding to FIG. 5 and showing a third embodiment of the present invention.

Next, a third embodiment of the present invention shown in FIG. 11 is described.

The third embodiment is different from the first embodiment in that: the holding members 22 and the elastic members 23 are attached to the inner cylinder 6; and the detent grooves 27*c* to 27*o* and the assembly grooves 29 are provided in an inner peripheral surface of the outer cylinder 7. Specifically, a plurality of attachment concave portions 21 are provided in the outer peripheral surface of the inner cylinder 6 in such a manner as to open to the inner peripheral surface of the outer cylinder 7. The holding members 22 engage the respective attachment concave portions 21 while being slidable in the radial direction. The holding groove 25 for holding the detent roller 26 is formed in each of the holding members 22. Each of the attachment concave portions 21 is filled with the elastic member 23 made of rubber to bias the holding member 22 toward the outer cylinder 7. The inner peripheral surface of the outer cylinder 7 is provided with the plurality of detent grooves 27*c* to 27*o* that each detent roller 26 engages and gets out of. Since the other configurations in the third embodiment are the same as those of the first embodiment, parts corresponding to those in the first embodiment are denoted by the same reference numerals in FIG. 11, and repetitive descriptions are avoided.

According to the third embodiment, the effects achieved by the first embodiment can also be achieved. Moreover, the plurality of detent grooves 27*c* to 27*o* are provided in the inner peripheral surface of the outer cylinder 7 having a diameter larger than the inner cylinder 6 has. Accordingly, the radius of rotation around the hinge pin 5 of the detent grooves 27*c* to 27*o* is relatively long, compared to the case where the detent grooves 27 are provided in the outer peripheral surface of the inner cylinder 6. This makes it possible to easily apply a large check torque to the door D. In the third embodiment, the holding member 22 may be replaced with the flexible member of the second embodiment.

The present invention is not limited to the above embodiments, and various design modifications may be made without departing from the gist of the invention. For example, the female bracket 1 may be fixed to the door D, and the male bracket 2 may be fixed to the body B. In addition, there may be a single position or a plurality of positions for the intermediate-opening position for the door D to be held by the checker-equipped door hinge device H. Moreover, the checker-equipped door hinge device H may be applied to a hinge device that supports a door for opening and closing a tailgate of a wagon-type vehicle.

What is claimed is:

1. A checker-equipped door hinge device for a vehicle, comprising:

a first bracket fixed to one of a body and a door;

a second bracket fixed to the other of the body and the door;

a hinge pin connecting the first and second brackets to each other while allowing the brackets to be relatively rotatable;

an inner cylinder connected integrally to the first bracket and disposed coaxially with the hinge pin;

an outer cylinder connected integrally to the second bracket and disposed so as to surround the inner cylinder in a rotatable manner relative to the inner cylinder; and a checking-force generating mechanism provided between the inner cylinder and the outer cylinder, and generating a checking force against the door at predetermined positions of the door, the predetermined positions including a fully closing position, an intermediate-opening position, and a fully opening position, the checking-force generating mechanism including a holding member attached to one of the inner cylinder and the outer cylinder, the holding member being capable of moving toward and from the other of the inner cylinder and the outer cylinder, an elastic member biasing the holding member toward the other of the inner cylinder and the outer cylinder, wherein at least one of the holding member and the elastic member encompass the inner cylinder, a detent roller held rotatably in a holding groove formed axially in the holding member, said detent roller being capable of moving in a rotational manner on a peripheral surface of the other of the inner cylinder and the outer cylinder, and a fully closing detent groove, an intermediate detent groove, and a fully opening detent groove which are provided in the peripheral surface of the other of the inner cylinder and the outer cylinder and at which the detent roller is capable of holding the door in the fully closing position, the intermediate-opening position, and the fully opening position, respectively, by a biasing force of the elastic member causing the detent roller to engage a corresponding one of the fully closing detent groove, the intermediate detent groove, and the fully opening detent groove, wherein the detent roller is configured to apply a compression load to the elastic member through the holding member even in a state where the detent roller is engaged with any of the detent grooves, and an assembly groove is provided in the peripheral surface of the other of the inner cylinder and the outer cylinder, the assembly groove allowing the detent roller to be inserted into the holding groove in a state where the holding member is in contact with the peripheral surface of the other of the inner cylinder and the outer cylinder.

2. The checker-equipped door hinge device for a vehicle according to claim 1, wherein the assembly groove is provided in the peripheral surface of the other of the inner cylinder and the outer cylinder at a position on an opposite side of the fully closing detent groove from the intermediate detent groove.

* * * * *